United States Patent [19]

Eastlund

[11] Patent Number: 5,038,664

[45] Date of Patent: Aug. 13, 1991

[54] METHOD FOR PRODUCING A SHELL OF RELATIVISTIC PARTICLES AT AN ALTITUDE ABOVE THE EARTHS SURFACE

[75] Inventor: Bernard J. Eastlund, Spring, Tex.

[73] Assignee: APTI, Inc., Washington, D.C.

[21] Appl. No.: 690,354

[22] Filed: Jan. 10, 1985

[51] Int. Cl.[5] ..... F41B 15/00

[52] U.S. Cl. ..... 89/1.11; 376/100; 376/123

[58] Field of Search ..... 376/100, 123; 89/1.11; 361/231; 342/352

[56] References Cited

U.S. PATENT DOCUMENTS 4,042,196 8/1977 Brice ..... 244/158 R

OTHER PUBLICATIONS

"A Theoretical Study of Electron-Cyclotron Absorption in Elmo Bumpy Torus", D. B. Batchelor et al., *Nuclear Fusion,* vol. 20, No. 4, 1980.

"The Radiation Belt & Magnetosphere", W. N. Hess, Blaisdell Publishing Co.; 1968, pp. 155 et sec.

"Ionosheric Modification Theory", G. Meltz et al.; *Radio Science,* vol. 9, No. 11, pp. 885-888; Nov. 1974.

"The Platteville High Power Facility", *Radio Science;* J. Carrdl et al.; vol. 9, No. 11, pp. 889-894, Nov. 1974.

"Arecibo Heating Experiment", W. Gordon et al., *Radio Science,* vol. 9, No. 11, pp. 1041-1047, Nov. 1974.

"Ionospheric Heating by Powerful Radiowaves", Meltz et al., *Radio Science* vol. 9, No. 11, pp. 1049-1063; Nov. 1974.

"Plasma Accleration with Microwaves Near Cyclotran Resonance", Kosmahl et al., *Journal of Applied Phsics;* vol. 38, No. 12, Nov. 1967; pp. 4576-4582.

"Particle Beam Weapons", J. Parmentola et al.; *Scientific American;* Apr. 1979, vol. 240, No. 4.

"Controlled Thermonuclear Reactions", S. Glasstone et al.; Robert Krieger Publishing Co.; Malabar, FIA; pp. 136-145; 1960.

"The MST Radar at Poke Flat"; *Radio Science;* vol. 15, No. 2; Mar.-Apr. 1980; pp. 213-223.

"A New Mechanism for Acclerating Electrons in the Outer Ionosphere"; Journal of Geophysical Research; R. Helliwel et al., vol. 65, No. 6, Jun. 1960.

"The Golden Book of Astronomy a Comprehensice & Prtical Survey"; S. Dunlop; Golden Press/New York; pp. 239-244.

*Primary Examiner*—Salvatore Cangioalosi

*Attorney, Agent, or Firm*—Roderick W. MacDonald

[57] ABSTRACT

A method for establishing a region of a high density, high energy plasma at an altitude of at least about 1500 kilometers above the earth's surface. Circularly polarized electromagnetic radiation is transmitted at a first frequency substantially parallel to an earth's magnetic field line to excite electron cyclotron resonance heating in normally occurring plasma at an altitude of at least about 250 kilometers to generate a mirror force which lifts said plasma to said altitude of at least about 1500 kilometers. Heating is continued at a second frequency to expand the plasma to the apex of said field line whereupon at least some of the plasma is trapped and oscillates between mirror points on said lines. The plasma will be contained within adjacent field lines and will drift to form a shell of relativistic particles around a portion of the earth.

7 Claims, 2 Drawing Sheets

METHOD FOR PRODUCING A SHELL OF RELATIVISTIC PARTICLES AT AN ALTITUDE ABOVE THE EARTHS SURFACE

DESCRIPTION

1. Technical Field

The present invention relates to a method for altering a selected region of plasma normally existing at a substantial altitude above the earth's surface and more particularly relates to a method for producing a magnetically-trapped shell of high density plasma having relativistic particles therein.

2. Background Art

In the late 1950's, it was discovered that naturally-occurring belts exist at high altitudes above the earth's surface, and it is now established that these belts result from charged electrons and ions becoming trapped along the magnetic lines of force (field lines) of the earth's essentially dipole magnetic field. The trapped electrons and ions are confined along the field lines between two magnetic mirrors which exist at spaced apart points along those field lines. The trapped electrons and ions move in helical paths around their particular field lines and "bounce" back and forth between the magnetic mirrors. These trapped electrons and ions can oscillate along the field lines for long periods of time In the past several years, substantial effort has been made to understand and explain the phenomena involved in belts of trapped electrons and ions and to explore possible ways to control and use these phenomena for beneficial purposes. For example, in the late 1950's and early 1960's, both the United States and U.S.S.R. detonated a series of nuclear devices of various yields to generate large numbers of charged particles at various altitudes, e.g., 200 kilometers (km) or greater. This was done in order to establish and study artificial belts of trapped electrons and ions. These experiments established that at least some of the extraneous electrons and ions from the detonated devices did become trapped along field lines in the earth's magnetosphere to form artificial belts which were stable for prolonged periods of time. For a discussion of these experiments see "The Radiation Belt and Magnetosphere", W. N. Hess, Blaisdell Publishing Co., 1968, pps. 155 et sec.

Other proposals which have been advanced for altering existing belts of trapped electrons and ions and/or establishing similar artificial belts include injecting charged particles from a satellite carrying a payload of radioactive beta-decay material or alpha emitters; and injecting charged particles from a satellite-borne electron accelerator. Still another approach is described in U.S. Pat. No. 4,042,196 wherein a low energy ionized gas, e.g. hydrogen, is released from a synchronous orbiting satellite near the apex of a radiation belt which is naturally occurring in the earth's magnetosphere to produce a substantial increase in energetic particle precipitation and, under certain conditions, produce a limit in the number of particles that can be stably trapped. This precipitation effect arises from an enhancement of the whistler-mode and ion-cyclotron mode interactions that results from the ionized gas or "cold plasma" injection.

It has also been proposed to release large clouds of barium in the magnetosphere so that photoionization will increase the cold plasma density, thereby producing electron precipitation through enhanced whistler-mode interactions.

However, in all of the above-mentioned approaches, the mechanisms involved in triggering the change in the trapped particle phenomena must be actually positioned within the affected zone, e.g., the magnetosphere, before they can be actuated to effect the desired change.

The earth's ionosphere is not considered to be a "trapped" belt since there are few trapped particles therein. The term "trapped" herein refers to situations where the force of gravity on the trapped particles is balanced by magnetic forces rather than hydrostatic or collisional forces. The charged electrons and ions in the ionosphere also follow helical paths around magnetic field lines within the ionosphere but are not trapped between mirrors as in the case of the trapped belts in the magnetosphere, as the gravitational force on the particles is balanced by collisional or hydrostatic forces.

In recent years, a number of experiments have actually been carried out to modify the ionosphere in some controlled manner to investigate the possibility of a beneficial result. For detailed discussions of these operations see the following papers: (1) Ionospheric Modification Theory; G. Meltz and F. W. Perkins; (2) The Platteville High Power Facility; Carrol et al.; (3) Arecibo Heating Experiments; W. E. Gordon and H. C. Carlson, Jr.; and (4) Ionospheric Heating by Powerful Radio Waves; Meltz et al., all published in Radio Science, Vol. 9, No. 11, November, 1974, at pages 885–888; 889–894; 1041–1047; and 1049–1063, respectively, all of which are incorporated herein by reference. In such experiments, certain regions of the ionosphere are heated to change the electron density and temperature within these regions. This is accomplished by transmitting from earth-based antennae high frequency electromagnetic radiation at a substantial angle to, not parallel to, the ionosphere's magnetic field to heat the ionospheric particles primarily by ohmic heating. The electron temperature of the ionosphere has been raised by hundreds of degrees in these experiments, and electrons with several electron volts of energy have been produced in sufficient numbers to enhance airglow. Electron concentrations have been reduced by a few percent, due to expansion of the plasma as a result of increased temperature.

In the Elmo Bumpy Torus (EBT) device, a major controlled fusion device at the Oak Ridge National Laboratory, all heating is provided by microwaves at the electron cyclotron resonance interaction. A ring of hot electrons is formed in the magnetic mirror by a combination of electron cyclotron resonance and stochastic heating. In the EBT, the ring electrons are produced with an average "temperature" of 250 kev ($2.5\times10^9$ K) and a plasma beta between 0.1 and 0.4; see, "A Theoretical Study of Electron - Cyclotron Absorption in Elmo Bumpy Torus", Batchelor and Goldfinger, Nuclear Fusion, Vol. 20, No. 4 (1980) pps. 403–418.

Electron cyclotron resonance heating has been used in experiments on the earth's surface to produce and accelerate plasmas in a diverging magnetic field. Kosmahl et al. showed that power was efficiently transferred from the electromagnetic waves and that a fully ionized plasma was accelerated with a divergence angle of roughly 13 degrees. Optimum neutral gas density was $1.7\times10^{14}$ per cubic centimeter; see, "Plama Acceleration with Microwaves Near Cyclotron Resonance", Kosmahl et al., Journal of Applied Physics, Vol. 38, No. 12, November, 1967, pps. 4576–4582.

It has heretofore been recognized that an intense focused beam of charged or neutral particles (e.g., plasma) can carry a potentially destructive amount of energy and is capable under certain circumstances of melting a hole in a piece of metal or of damaging even shielded electronic circuits. Recently, proposals have been set forth to exploit such particle beams as possible defense mechanisms to be used to protect against offensive missiles which may be launched by a hostile power; see "Particle-Beam Weapons"; J. Parmentola and K. Tsipis; Scientific American, April, 1979, Vol. 240, No. 4, which is incorporated herein by reference.

In such proposals, a particle accelerator is mounted in a satellite in an earth orbit at a 1000 km altitude and, when actuated, will increase the kinetic energy of a large number of individual atomic ions or subatomic charged particles and then direct them collectively at a target. A typical accelerator consists of a source of particles, a device for injecting the particles into the accelerator, and a series of accelerating sections. Every particle that strikes a target will transfer some of its energy to the material of the target. Given a large enough number of particles hitting the target in a short enough time, the deposited energy can become great enough to burn a hole in the "skin" of the target (e.g., missile) to denotate the chemical-explosive "trigger" of a warhead or to disrupt the electronics (e.g., guidance controls) inside the target vehicle. However, in these proposals, the accelerator has to be placed in orbit to generate the required "beam" of charged particles, and has to be accurately placed so that the beam can be aimed directly at the target.

DISCLOSURE OF THE INVENTION

This invention provides a method for establishing an upper region of a high density (i.e., electron concentration), high energy plasma at a selected altitude, e.g., at least about 1500 km, above the surface of the earth. Plasma (i.e., charged particles) which normally exists at a lower region, e.g., altitude of at least about 250 km, is excited by first electron cyclotron resonance heating to thereby increase the charged particle energy. This is done by transmitting circularly polarized electromagnetic radiation from a point at or near the location where a naturally-occurring dipole magnetic field (force) line intersects the earth's surface. The radiation is deliberately transmitted at the outset in a direction substantially parallel to and along the field line which extends upwardly through the region or regions of plasma to be altered. The radiation is transmitted at a first frequency, e.g., from about 1000 to about 3600 kilohertz (kHz) based on the gyrofrequency of the charged particles in the lower regions. When applied to the plasma in said region, the radiation excites electron cyclotron resonance within the plasma to heat and accelerate the charged particles in their respective helical paths around and along the field line. This increase in energy causes ionization of neutral particles which then become a part of the plasma thereby increasing the charged particle density of the plasma.

This first electron cyclotron resonance heating is carried out at sufficient power levels to allow the plasma to generate a mirror force which forces the charged electrons of the altered plasma upward along the force line to said upper region.

Circularly polarized electromagnetic radiation of a second frequency (e.g., from about 20 to about 1800 kHz) is employed to excite a second electron cyclotron resonance heating in the plasma at the level of said upper region to further and further ionize said plasma. This heating is continued until the plasma has expanded to the apex of said divergent magnetic field lines at which time at least some of the plasma is trapped along said field lines and oscillates between magnetic mirror points on said lines. As energy is absorbed by the trapped electrons by continued second electron cyclotron resonance heating, the mirror points of the particles forming the altered plasma will be raised from their original positions in the lower region to the point in the upper region where said second electromagnetic radiation is being absorbed. Further, as trapped particles oscillate back and forth between the hemispheres, they will be heated stochastically since they pass repeatedly through the heating region, that is the said upper region. The stochastic heating will be continued until the electron energies reach the range of from about 2 to about 5 Mev, at which the electrons are relativistic because of the electron masses having been increased substantially due to their high velocities. This increases the density or electron concentration of the trapped plasma to $10^9$ per cubic centimeter.

The plasma will be confined between adjacent field lines and will form a shell of relativistic particles therebetween as these particles naturally "drift" around the earth. The shell so formed may be used as an anti-missile shield. The high energy, relativistic particles in the shell will collide with any missile passing therethrough to give up energy which, in turn, will damage or destroy the missile.

BRIEF DESCRIPTION OF THE DRAWINGS

The actual construction, operation, and apparent advantages of the present invention will be better understood by referring to the drawings in which like numerals identify like parts and in which.

BEST MODES FOR CARRYING OUT THE INVENTION

Figure 1:
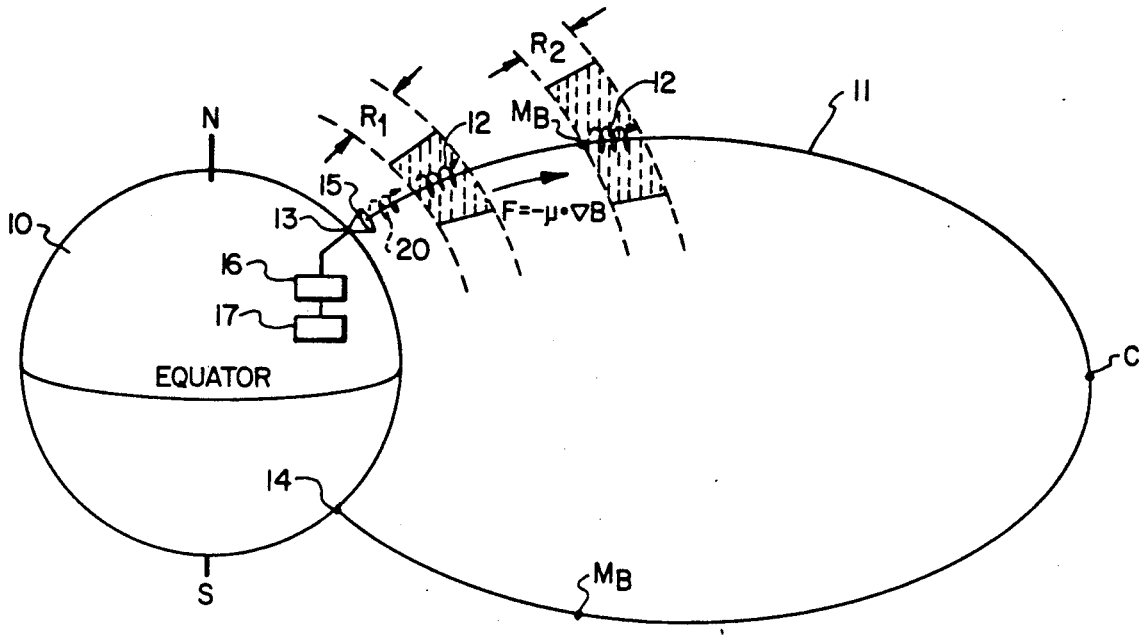
FIG. 1 is a simplified, schematical view of the earth (not to scale) and a magnetic field (force) line along which the present invention is carried out.

The earth's magnetic field is somewhat analogous to a dipole bar magnet. As such, the earth's magnetic field contains numerous divergent field or force lines, each line intersecting the earth's surface at two points on opposite sides of the equator. The field lines which intersect the earth's surface near the poles have apexes which lie at the furthest points in the earth's magnetosphere while those closest to the equator have apexes which reach only the lower portion of the magnetosphere and below.

In both the earth's ionosphere and the magnetosphere, plasma is present along these field lines. This plasma consists of equal numbers of positively and negatively charged particles (i.e., electrons and ions) which are guided by the field line. It is well established that a charged particle in a magnetic field gyrates about field lines; the center of gyration at any instance being called the "guiding center" of the particle. As the gyrating particle moves along a line of force in a uniform field, it will follow a helical path about its guiding center, which moves linearly along the field line. Electrons and ions both follow helical paths around a field line but rotate in opposite directions. The frequencies at which the electrons and ions rotate about the field line are called gyromagnetic frequencies or cyclotron frequencies because they are identical with the expression for the angular frequencies of gyration of particles in a cyclotron. The cyclotron frequency of ions in a given magnetic field is less than that of electrons, in inverse proportion to their masses.

If the particles which form the plasma along the earth's field lines continued to move with a constant pitch angle, often designated "alpha", they would soon impact on the earth's surface; pitch angle alpha being defined as the angle between the direction of the earth's magnetic field and the velocity (V) of the particle. However, in converging force fields, the pitch angle does change in such a way as to allow the particle to turn around and avoid impact. Consider a particle moving along a field line down toward the earth. It moves into a region of increasing magnetic field strength and therefore sine alpha increases. But sine alpha can only increase to 1.0, at which point, the particle turns around and starts moving up along the field line, and alpha decreases. The point at which the particle turns around is called the mirror point, and there alpha equals ninety degrees. This process is repeated at the other end of the field line where the same magnetic field strength value B, namely Bm, exists. The particle again turns around and this is called the "conjugate point" of the original mirror point. The particle is therefore trapped and bounces between the two magnetic mirrors. The particle can continue oscillating in space in this manner for long periods of time. The actual place where a particle will mirror can be calculated from the following:

$$\sin^2 \text{alpha}_o = B_o/B_m \quad (1)$$

wherein:

$\text{alpha}_o$ = equatorial pitch angle of particle $B_o$ = equatorial field strength on particular field line $B_m$ = field strength at the mirror point Recent discoveries have established that there are substantial regions of naturally trapped particles in space which are commonly called "trapped radiation belts". These belts occur at altitudes greater than about 500 km and accordingly lie in the magnetosphere and mostly above the ionosphere.

The ionosphere, while it may overlap some of the trapped-particle belts, is a region in which hydrostatic forces govern its particle distribution in the gravitational field. The motion of the ionosphere is governed by both hydrodynamic and electrodynamic forces. While there are few trapped particles in the ionosphere, nevertheless, plasma is present along field lines in the ionosphere. The charged particles which form this plasma move between collisions with other particles along similar helical paths around the field lines and although a particular particle may diffuse downward into the earth's lower atmosphere or diverge from its original field line due to collisions with other particles, these charged particles are normally replaced by other available charged particles. The electron density or concentration ($N_e$) of the plasma will vary with the actual conditions and locations involved. Also, neutral particles, ions, and electrons are present in proximity to the field lines.

As known in plasma physics, the characteristics of a plasma can be altered by adding energy to the charged particles or by ionizing additional particles to increase the density of the plasma. One way to do this is by heating the plasma which can be accomplished in different ways, e.g., ohmic, magnetic compression, shock waves, magnetic pumping, electronic cyclotron resonance, and the like.

Since electron cyclotron resonance heating is involved in the present invention, a brief discussion of same is in order. Increasing the energy of electrons in a plasma by invoking electron cyclotron resonance heating, is based on a principle similar to that utilized to accelerate charged particles in a cyclotron. If a plasma is confined by a static axial magnetic field of strength B, the charged particles will gyrate about the lines of force with a frequency given, in hertz, as $f_g = 1.54 \times 10^3 B/A$, where: B = magnetic field strength in gauss, and A = mass number of the ion.

Suppose a time-varying field of this frequency is superimposed on the static field B confining the plasma, by passage of a radiofrequency current through a coil which is concentric with that producing the axial field, then in each half-cycle of their rotation about the field lines, the charged particles acquire energy from the oscillating electric field associated with the radio frequency. For example, if B is 10,000 gauss, the frequency of the field which is in resonance with protons in a plasma is 15.4 megahertz.

As applied to electrons, electron cyclotron resonance heating requires an oscillating field having a definite frequency determined by the strength of the confining field. The radio-frequency radiation produces time-varying fields (electric and magnetic), and the electric field accelerates the charged particle. The energized electrons share their energy with ions and neutrals by undergoing collisions with these particles, thereby effectively raising the temperature of the electrons, ions, and neutrals. The apportionment of energy among these species is determined by collision frequencies. For a more detailed understanding of the physics involved, see "Controlled Thermonuclear Reactions", Glasstone and Lovberg, D. Van Nostrand Company, Inc., Princeton, N.J., 1960 and "The Radiation Belt and Magnetosphere", Hess, Blaisdell Publishing Company, 1968, both of which are incorporated herein by reference.

Referring now to the drawings, the present invention provides a method for altering an upper region of plasma which lies along a field line when it passes through the ionosphere and/or magnetosphere. FIG. 1 is a simplified illustration of the earth 10 and one of its essentially dipole magnetic force or field lines 11. As will be understood, line 11 may be any one of the numerous naturally existing field lines and the actual geographical locations 13 and 14 of line 11 will be chosen based on the particular operation to be carried out. The actual locations at which field lines intersect the earth's surface is documented and is readily ascertainable by those skilled in the art.

Line 11 passes through region $R_1$ which lies at an altitude, e.g., at least about 250 kilometers (km) above the earth's surface. As explained above, plasma will be present along line 11 within region $R_1$ and is represented by the helical line 12. Plasma 12 is comprised of charged particles (electrons and ions) which rotate about opposing helical paths along line 11.

Antenna 15 is positioned as close as practical to the location 14 where line 11 intersects the earth's surface. Antenna 15 may be of any known construction for high directionality, for example, a phased array, beam spread angle ($\theta$) type; see "The MST Radar at Poker Flat, Alaska", Radio Science, Vol. 15, No. 2, March–April 1980, pps. 213–223, which is incorporated herein by reference. Antenna 15 is coupled to transmitter 16 which generates high frequency electromagnetic radiation at a wide range of discrete frequencies, e.g., from about 20 to about 7200 kHz.

Transmitter 16 is powered by power generator means 17 which is preferably comprised of one or more commercial electrical generators such as magnetogydrodynamic, turbine, fuel cell, electrogasdynamic generators, and the like. Some embodiments of the present invention require large amounts of power, e.g., up to $10^{10}$ watts, in continuous wave or pulsed power. Generation of the needed power is within the state of the art. The electrical generators can be powered in any known manner, e.g., nuclear reactors, hydroelectric facilities, hydrocarbon fuels in areas where large supplies are available, and the like.

In FIG. 1, a first step of the present invention is illustrated where a selected region $R_1$ of plasma 12 is altered by electron cyclotron resonance heating to accelerate the electrons of plasma 12, which are following helical paths along line 11.

To accomplish this result, electromagnetic radiation is transmitted at the outset, essentially parallel to field line 11 via antenna 15 as circularly polarized radiation wave 20 (right-hand circularly polarized in the Northern Hemisphere and left-hand in the Southern Hemisphere). Wave 20 has a frequency which will excite electron cyclotron resonance with plasma 12 at its initial or original altitude. This frequency (from about 20 to about 7200 kHz) will vary depending on the electron cyclotron resonance or harmonic of the resonance of region $R_1$ which, in turn, can be determined from available data based on the altitude of region $R_1$, the particular field line 11 being used, the strength of the earth's magnetic field, etc. Also, for any given application, there will be a threshhold (minimum power level) which is needed to produce the desired result. The minimum power level is a function of the level of plasma production and movement required, taking into consideration any loss processes that may be dominant in a particular plasma or propagation path.

As electron cyclotron resonance is established in plasma 12, energy is transferred from the electromagnetic radiation 20 into plasma 12 to heat and accelerate the electrons, and subsequently ions and neutrals. As this process continues, neutral particles which are present within $R_1$ are ionized and absorbed into plasma 12 and this increases the electron and ion densities of plasma 12. As the electron energy is raised to values of about 1 kilo electron volt (kev), the generated mirror force (explained below) will direct the excited plasma 12 upward along line 11 into a second region $R_2$ which is at an altitude higher than that of $R_1$.

Plasma acceleration results from the force on an electron produced by a nonuniform static magnetic field ($\bar{B}$). The force, called the mirror force in this context, is given by $$F = -\mu \nabla B \qquad (2)$$

where $\mu$ is the electron magnetic moment and $\nabla$ B is the gradient of the magnetic field, $\mu$ being further defined as:

$$W_\perp/B = mV_\perp^2/2B$$

where $W_\perp$ is the kinetic energy in the direction perpendicular to that of the magnetic field lines and B is the magnetic field strength at the line of force on which the guiding center of the particle is located. The force as represented by equation (2) is the force which is responsible for a particle obeying equation (1).

Since the magnetic field is divergent in region $R_1$, it can be shown that the plasma will move upwardly from the heating region as shown in FIG. 1 and further it can be shown that $$\tfrac{1}{2}M_eV_{e\perp}^2(x) \approx \tfrac{1}{2}M_eV_{e\perp}^2(Y) + \tfrac{1}{2}M_iV_{i11}^2(Y) \qquad (3)$$

where the left hand side is the initial electron transverse kinetic energy; the first term on the right is the transverse electron kinetic energy at some point (Y) in the expanded field region, while the final term is the ion kinetic energy parallel to B at point (Y). This last term is what constitutes the desired ion flow. It is produced by an electrostatic field set up by electrons which are accelerated according to Equation (2) in the divergent field region and pulls ions along with the them. Equation (3) ignores electron kinetic energy parallel to B because $V_{e11} \approx V_{i11}$, so the bulk of parallel kinetic energy resides in the ions because of their greater masses. For example, if an electromagnetic energy flux of from about 0.1 to about 1 watts per square centimeter is applied to region $R_1$, whose altitude is about 250 km, a plasma having a density ($N_e$) of $10^9$ per cubic centimeter and an ion energy of about 3 ev will be generated and moved upward to region $R_2$, which has an altitude of about 1500 km. The movement of electrons in the plasma is due to the mirror force while the ions are moved by ambipolar diffusion (which results from the electrostatic field). This effectively "lifts" a layer of plasma 12 from $R_1$ to the higher elevation $R_2$.

Figure 2:
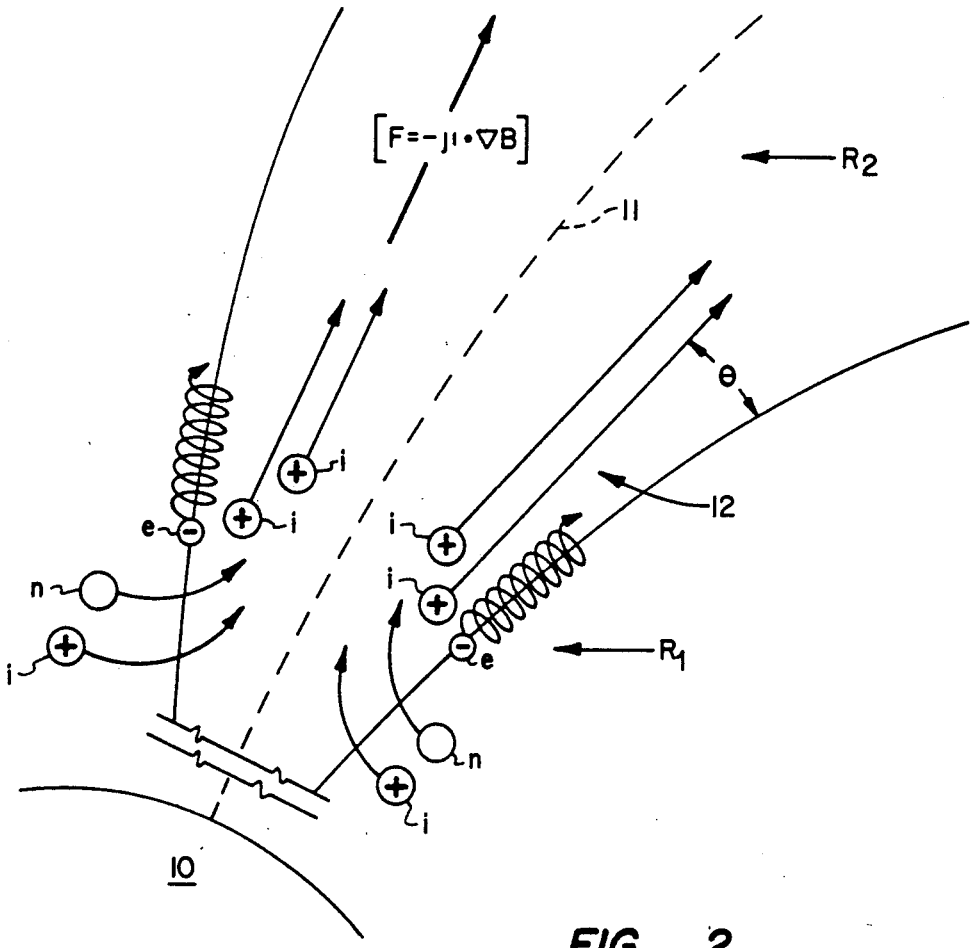
FIG. 2 is a simplified, idealized representation of a physical phenomenon involved in the present invention.

FIG. 2 is an idealized representation of movement of plasma 12 upon excitation by electron cyclotron resonance within the earth's divergent force field. Electrons (e) are accelerated to velocities required to generate the necessary mirror force to cause their upward movement. At the same time neutral particles (n) which are present along line 11 in region $R_1$ are ionized and become part of plasma 12. As electrons (e) move upward along line 11, they drag ions (i) with them but at an angle $\theta$ of about 13 degrees to field line 11. The ions, in turn, will drag the neutrals n along by colliding with them. Also, any particulates that may be present in region $R_1$, will be swept upwardly with the plasma. As the charged particles of plasma 12 move upward, other particles such as neutrals within or below $R_1$, move in to replace the upwardly moving particles. These neutrals, under some conditions, can drag with them charged particles from adjoining regions.

Figure 3:
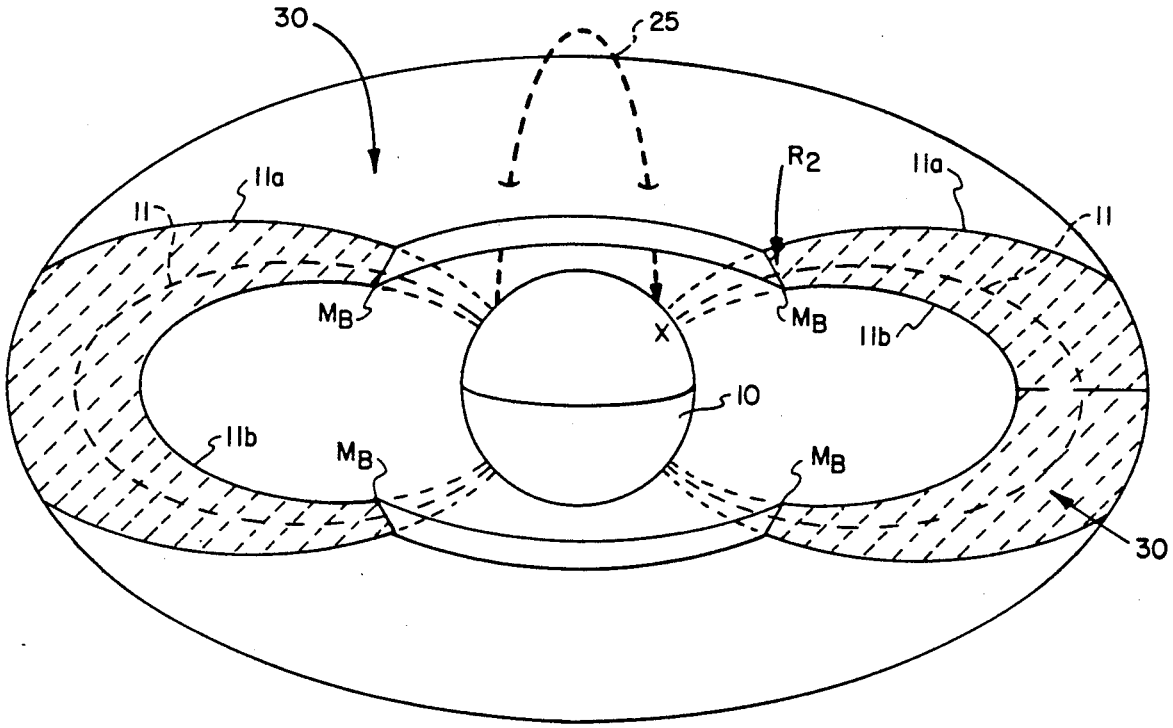
FIG. 3 is a simplified, perspective view of a high intensity, plasma shell formed in accordance with the present invention.

Referring now to FIGS. 1 and 3, plasma 12 having a density of $10^9$ per cubic centimeter and an ion energy of about 3 ev is formed in region $R_2$ by heating plasma 12 within region $R_1$ and moving it upward along field line 11 (e.g., earth field line $L_4$) to region $R_2$ which lies at an altitude of about 1500 km. To raise the necessary volume of plasma for the present invention, a total energy of $10^{15}$ joules will be applied through the electron cyclotron resonance heating of region $R_1$. After the plasma 12 is raised to region $R_2$, circularly polarized electromagnetic radiation having a second, different frequency (e.g., about 1.0 MHz) is transmitted to upper region $R_2$ where it further excites electron cyclotron resonance heating within plasma 12 in region $R_2$. This radiation having a second different frequency can be supplied by adjusting the frequency of the original radiation used in region $R_1$, and/or supplied by way of separate source of radiation. By further exciting the electrons to 10 ev per electron, plasma 12 will expand along line 11 to apex point C. When this occurs, a substantial portion of plasma 12 becomes trapped along line 11 and oscillates thereon between mirror points $M_B$. The mirror points for the trapped particles of the altered plasma will be raised from their original mirror points $M_A$ (FIG. 1) in region $R_1$ to mirror point $M_B$ in the upper region $R_2$ by the continued second resonance cyclotron resonance heating as it is being applied to the particles in the upper region $R_2$. The oscillation of the particles will then allow additional heating by stochastic heating which is associated with trapped and oscillating particles; see "A New Mechanism for Accelerating Electrons in the Outer Ionosphere" by R. A. Helliwell and T. F. Bell, Journal of Geophysical Research, Vol. 65, No. 6, June, 1960, which is incorporated herein by reference.

The continued excitation of electron cyclotron resonance heating in region $R_2$ coupled with the stochastic heating that occurs due to oscillation on field line 11 will excite the electrons of plasma 12 to energies of from about 2 to about 5 Mev thereby making them relativistic (i.e., particles whose mass has increased due to high velocities). This combined heating effect is similar to Elmo Bumpy Torus (EBT) heating. As plasma 12 oscillates on line 11 above mirror points $M_B$, it is contained between divergent field lines 11*a* and 11*b* (FIG. 3) which lie adjacent line 11, as will be understood by those skilled in the art.

Particles trapped on a earth's magnetic field will naturally migrate or "drift" laterally around the earth's circumference following a path defined by a particular magnetic field shell (e.g., $L_4$) which is present at substantially the same latitude around the earth. The plasma will drift until a shell 20 is formed having a width (w) in region $R_2$. The total energy to generate a shell 20 of relativistic particles having an average width in region $R_2$ of 100 kilometers and a particle density of $10^9$ per cubic centimeter and a particle energy of 6 Mev will be about $10^{19}$ joules.

Shell 20, once formed, provides an anti-missile, relativistic electron barrier that will detonate or serverly damage the electronic system of any missile that passes therethrough. As illustrated in FIG. 3, an intercontinental ballistic missile (ICBM) that is launched along a trajectory such as shown by the heavy dashed line 25, will have to pass through shell 20 twice on its way to target X (once on its ascent and once upon reentry).

As the missile passes through shell 20, the (high intensity (e.g., 6 Mev) particles of plasma 12 penetrate the missile. As each particle does this, it loses energy principally by transferring energy to electrons in the missile by a series of elastic collisions giving a cascade of electrons which leaves the direction of the mo ion largely undisturbed. Eventually, the energy lost in the material of the missile manifests itself as heat thereby raising the temperature of the material where the particles collide. At the density and energy levels of plasma 12 within shell 20, the rate of energy deposition (i.e., heating) will be greater than can be dissipated and the material will melt or crack under thermal stress. Detectable damage will result either from burning through the walls of the missile's fuel container, damaging the electronic systems of the missile, or from detonation of the chemical-explosive triggers of the missile's warhead; the latter requiring about 200 joules per cubic centimeter of material impacted.

It can be seen from the above, that by generating a shell 20 of high density, relativistic particle plasma, an effective defensive shield can be provided to guard against offensive missiles.

I claim:

1. A method for establishing a region of a plasma at an altitude of at least about 1500 km above the surface of the earth, said method comprising:

providing at least one source of circularly polarized electromagnetic radiation having a first frequency in the range of from about 1800 to about 3600 kHz;

transmitting said electromagnetic radiation from said earth's surface substantially parallel to and along at least one of the earth's naturally occurring and diverging magnetic field lines and focused so as to provide a power flux of about 0.1 to about 1 watt per square centimeter at an altitude of at least 250 km;

adjusting said first frequency of said electromagnetic radiation to a value which will excite a first electron cyclotron resonance within plasma which normally exists adjacent said field line at a first altitude of at least about 250 km whereby said electron cyclotron resonance causes heating and further ionization of said plasma to form a plasma having an ion energy of at least 3 ev;

continuing to excite said first electron cyclotron resonance for a time between 0.1 and 1200 seconds sufficient to cause movement of said plasma upward along said diverging magnetic field lines from said first altitude to said region at said altitude of at least about 1500 km;

providing electromagnetic radiation having a second frequency in the range of from about 20 to 1800 kHz and different from said first frequency and which will excite further electron cyclotron resonance in said plasma after it has moved to said region to further heat and to further ionize said plasma and to raise the mirror points of said plasma; and continuing to excite said second electron cyclotron resonance in said plasma to produce relativistic electrons in said plasma having an electron energy up to 20 million electron volts.

2. The method of claim 1 wherein the excitation of said first electron cyclotron resonance is continued for a sufficient time of about 1200 seconds to expand said plasma upward along said diverging magnetic field lines to the apex of said lines to thereby trap at least some of said plasma which causes said plasma to oscillate between magnetic mirror points on said field lines and to be further heated by stochastic heating.

3. The method of claim 2 wherein said second electron resonance is continued until the electron concentration of said trapped plasma reaches at least about $10^9$ per cubic centimeters.

4. The method of claim 2 wherein the energy of the relativistic electrons in said trapped plasma is at least about 2 million electron volts.

5. The method of claim 4 wherein said first electron cyclotron resonance is continued until a shell of relativistic electrons is formed by natural drift of said electrons around the earth's circumference.

6. The method of claim 5 wherein the width of said shell is at least about 100 km.

7. The method of claim 6 wherein said shell is formed as an anti-missile shield.

* * * * *